US007353802B1

(12) United States Patent
Iwata et al.

(10) Patent No.: US 7,353,802 B1
(45) Date of Patent: Apr. 8, 2008

(54) GOVERNOR WITH TAKE-UP SPRING

(75) Inventors: Hisaya Iwata, Brookfield, WI (US); Bradley Demi, Campbellsport, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 0 days.

(21) Appl. No.: 11/651,734

(22) Filed: Jan. 10, 2007

(51) Int. Cl.
*F02D 31/00* (2006.01)
*F02D 11/04* (2006.01)

(52) U.S. Cl. ..... 123/376; 123/363

(58) Field of Classification Search ..... 123/376, 123/396, 400, 403, 363, 372
See application file for complete search history.

(56) References Cited

U.S. PATENT DOCUMENTS

| | | | | |
|---|---|---|---|---|
| 2,382,952 | A * | 8/1945 | Armstrong | 123/376 |
| 3,276,439 | A * | 10/1966 | Reichenbach | 123/376 |
| 4,182,196 | A * | 1/1980 | Glass | 74/491 |
| 4,631,153 | A * | 12/1986 | Tamba et al. | 261/52 |
| 4,773,371 | A | 9/1988 | Stenz | |
| 4,793,309 | A | 12/1988 | Huffman et al. | |
| 4,836,167 | A | 6/1989 | Huffman et al. | |
| 5,003,949 | A | 4/1991 | Fanner et al. | |
| 5,146,889 | A | 9/1992 | Swanson et al. | |
| 5,503,125 | A | 4/1996 | Gund | |
| 6,983,736 | B2 * | 1/2006 | Mitchell et al. | 123/376 |
| 2003/0029418 | A1 * | 2/2003 | Deschamps et al. | 123/376 |

OTHER PUBLICATIONS

Hisaya Iwata, et al., "Governor with Low Droop Having Opposed Spring", U.S. Appl. No. 11/649,660, filed Jan. 4, 2007, unpublished, commonly-owned with U.S. Appl. No. 11/651,734, filed Jan. 10, 2007.

* cited by examiner

*Primary Examiner*—Mahmoud Gimie
(74) *Attorney, Agent, or Firm*—Michael Best & Friedrich LLP

(57) ABSTRACT

A governor for an engine includes a speed sensor coupled to the engine that moves in response to changes in engine speed. The governor further includes a linkage coupled between the speed sensor and a throttle member to move the throttle member between a first position and a second position. A governor spring couples to the throttle member. A friction spring couples to the throttle member and includes a coil portion frictionally engaged with the linkage.

20 Claims, 7 Drawing Sheets

GOVERNOR WITH TAKE-UP SPRING

BACKGROUND

The present invention relates to a governor for an internal combustion engine, and more particularly to a mechanical governor with a take-up spring for a small engine.

Governors are generally used to regulate and stabilize the speed of engines, such as internal combustion engines. The governor generally receives an input indicative of an engine speed and moves an engine throttle to adjust the engine speed. A governor spring affects movement of the throttle such that the governed speed of the engine is determined by the interplay between the movement of the throttle and the spring force of the governor spring.

A typical governor provides continuous adjustment to a throttle or other control member in an effort to maintain a constant engine speed. The governor generally includes several linkages or connections that can cause inaccuracies in engine control. For example, if a sudden load change produces a speed change, this will be sensed and passed through the linkage to produce movement of the throttle. However, if the various linkages are not tightly connected, the movement at one end of the linkage may not translate to the throttle, thereby resulting in inaccurate engine control.

In many internal combustion engines, these inaccuracies may result in engine hunting. Hunting occurs when the engine overshoots or undershoots the desired speed without quickly settling at the desired speed. Hunting can be caused by many factors, including the use of springs having incorrect spring rates, sticking or binding between movable parts of the engine and the governor, excessive clearance between components, and the like.

SUMMARY

In one embodiment, the invention provides a governor for an engine. The governor includes a speed sensor coupled to the engine that moves in response to changes in a speed of the engine. The governor further includes a linkage coupled between the speed sensor and a throttle member to move the throttle member between a first position and a second position. A governor spring is coupled to the throttle member. A friction spring is coupled to the throttle member and includes a coil portion frictionally engaged with at least a portion of the linkage.

In another embodiment, the invention provides an internal combustion engine that includes a cylinder and a piston disposed within the cylinder that is reciprocal in response to combustion of a fuel. The engine further includes a speed sensor that moves in response to changes in a speed of the engine. A linkage is coupled to the speed sensor and is movable in a first direction and second direction. The linkage is coupled between the speed sensor and the throttle member and moves in a first direction and a second direction to vary the throttle member between a first position and a second position. A governor spring is attached to the throttle member to bias the throttle member in a first direction. A friction spring is coupled to the governor arm and the throttle member to resist movement of the linkage in both the first direction and the second direction.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
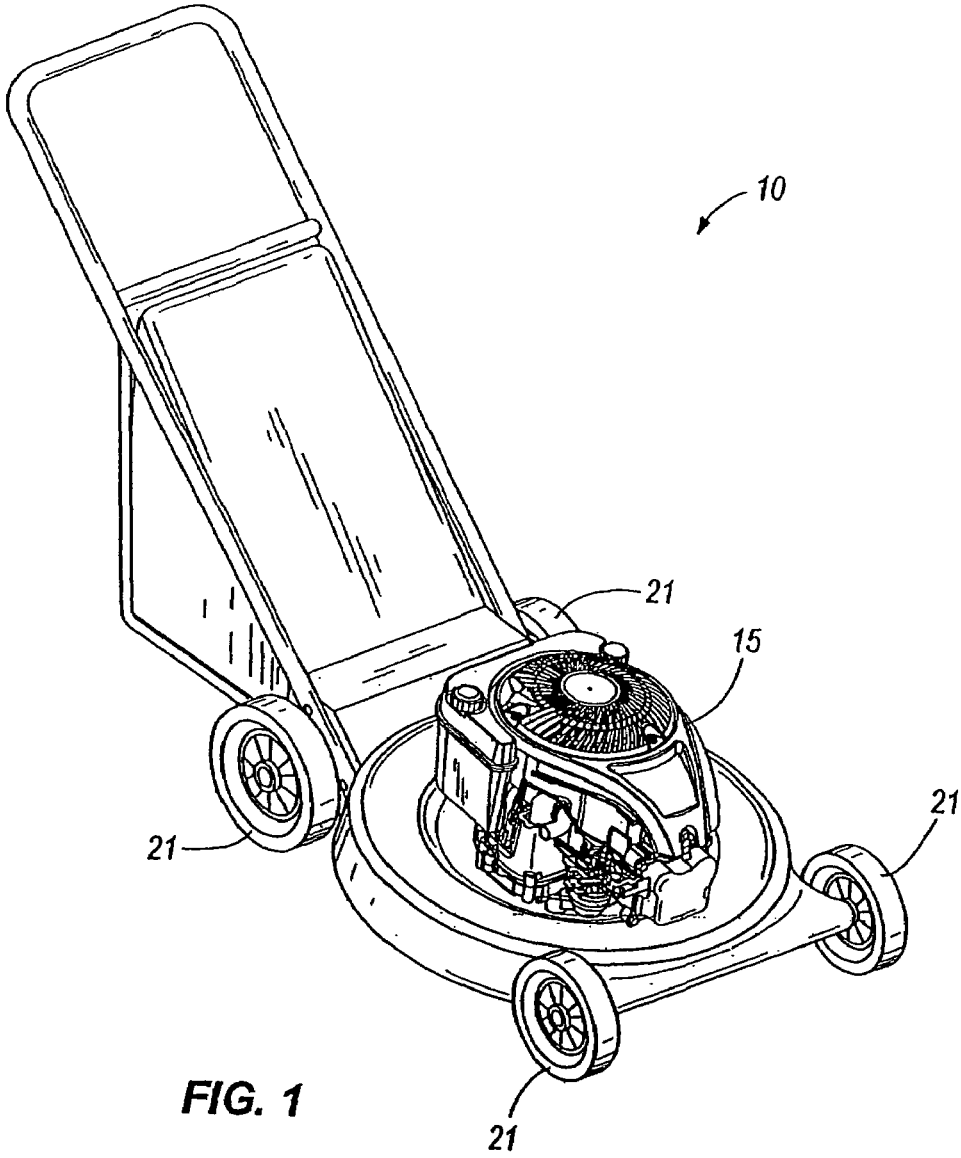
FIG. 1 is a perspective view of a lawnmower including an internal combustion engine.
Figure 2:
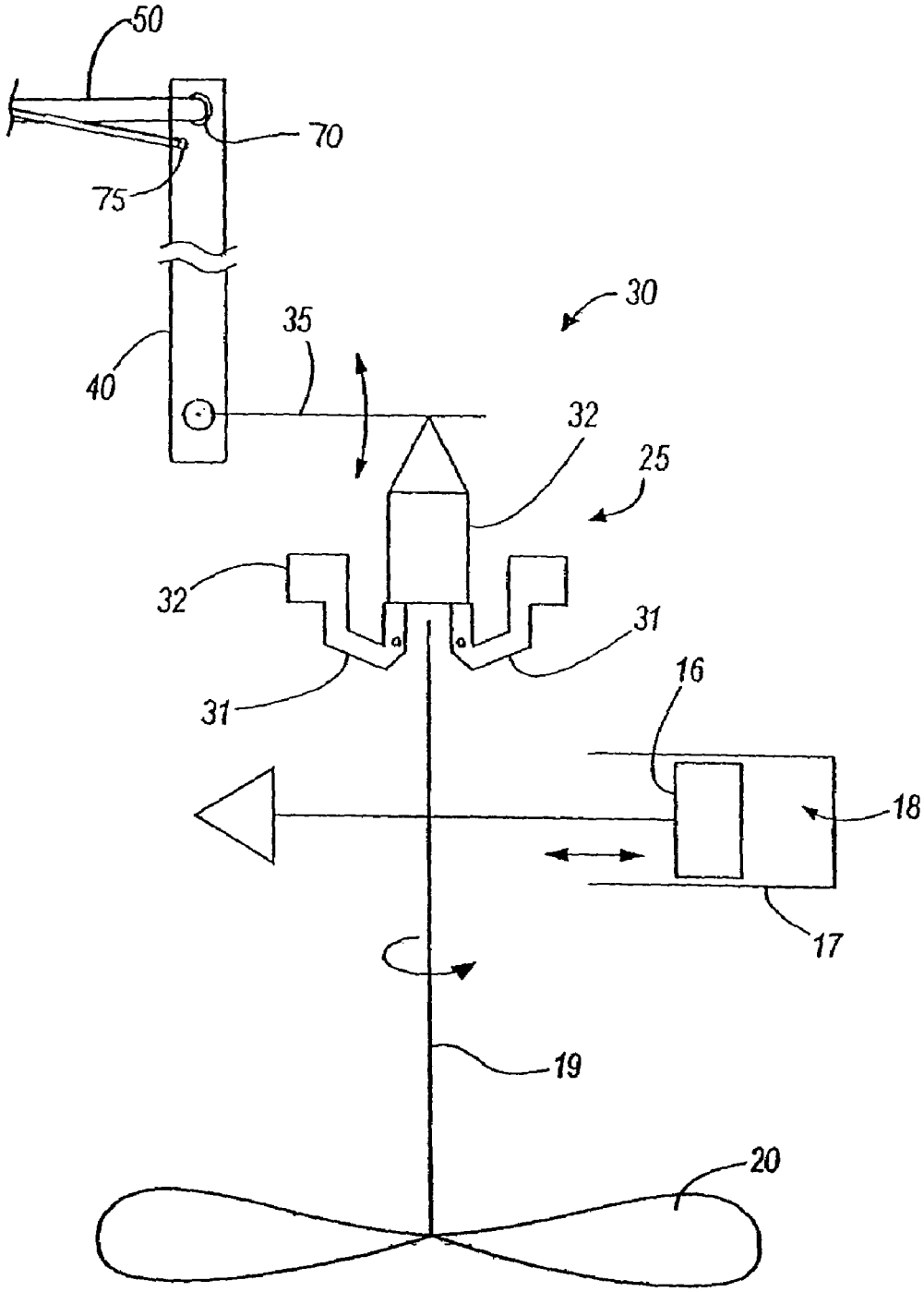
FIG. 2 is a schematic view of a portion of the engine of FIG. 1.

FIG. 1 illustrates a lawn mower 10 that includes a small engine 15. As shown in FIG. 2, the engine 15 includes a piston 16 that reciprocates within a cylinder 17 in response to combustion of an air-fuel mixture within a combustion chamber 18. The reciprocation of the piston 16 produces a corresponding rotation of a crankshaft 19, which in turn rotates a mower blade 20, or rotates another device (e.g., the rotor of a motor or alternator, a pump shaft, or a snow blower auger, etc.). In some arrangements, the rotating crankshaft 19 also provides power to one or more wheels 21 to propel the lawn mower 10 (see FIG. 1).

Before proceeding, it should be noted that the term "small engine" as used herein generally refers to an internal combustion engine that includes one or two cylinders. The engine can be arranged with a horizontal or a vertical crankshaft as may be required. While the invention discussed herein is particularly suited for use with small engines, one of ordinary skill in the art will realize that it could be applied to larger engines (i.e., three or more cylinders) as well as other engine designs (e.g., rotary engine, radial engine, diesel engines, combustion turbines, and the like) that include a mechanical governor. As such, the invention should not be limited to the small engine application described herein.

As schematically illustrated in FIG. 2, the engine 15 further includes a mechanical governor 30 having a speed sensor 25. The speed sensor 25 may be driven by a gear (e.g., a cam gear, timing gear, idler gear, etc.) that rotates with the crankshaft 19. The speed sensor 25 is configured to generate a signal that is related to the rotational speed of the crankshaft 19, typically one-half of the crankshaft speed. The signal can be a mechanical or positional signal, or alternatively an electrical signal (e.g., frequency, pulse, current, voltage, etc.) that is indicative of the rotational speed of the crankshaft 19.

In the embodiment shown in FIG. 2, the speed sensor 25 includes centrifugally-responsive flyweights 31 that engage a plunger 32, which in turn engages a governor shaft 35 to move a governor arm 40 of the governor 30. The plunger 32 moves in response to movement of the flyweights 31 between a first position and a second position based on a rotational speed of the crankshaft 19. In other embodiments, the engine 15 may include a governor air vane adjacent a flywheel fan of the engine 15. Airflow generated by the flywheel fan displaces the air vane to generate the signal. Other governors may include electrical speed sensors, such as magnetic pick-ups or Hall sensors that generate an electrical signal indicative of engine speed when passed by a flywheel magnet.

Figure 3:
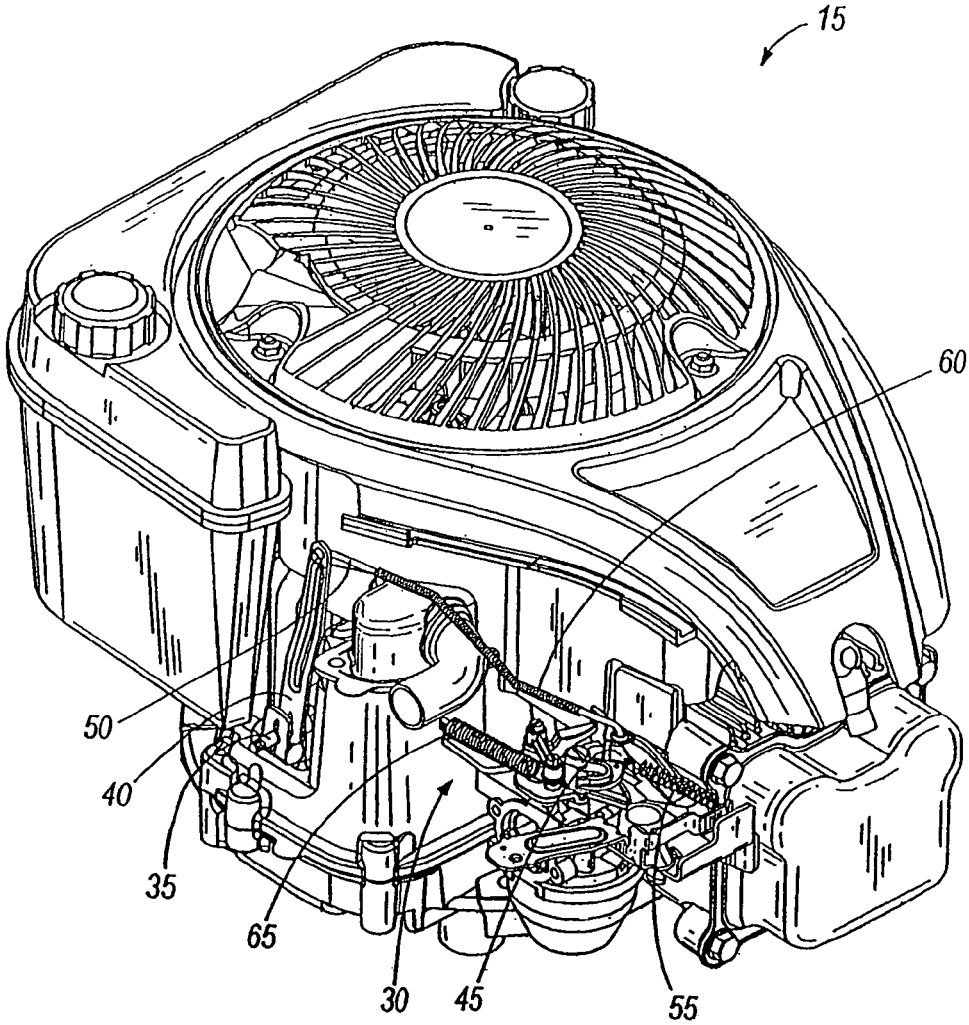
FIG. 3 is a perspective view of the engine of FIG. 1, including a governor.

FIG. 3 shows the engine 15 that further includes a throttle lever 45 positioned adjacent an intake passageway 95 (FIG. 6), and a choke spring 65 that biases a choke (not shown) between an open position and a closed position. The throttle lever 45 is movable between a first position and a second position to vary the flow of the air-fuel mixture through the passageway 61 to the combustion chamber 18. The first position and the second position may be any distinct positions of the throttle lever 45. In one embodiment, the first position defines an open position (i.e., wide-open throttle) and the second position defines a substantially closed position. However, other embodiments may define the first and second positions as any distinct positions between open and closed positions.

Figure 5:
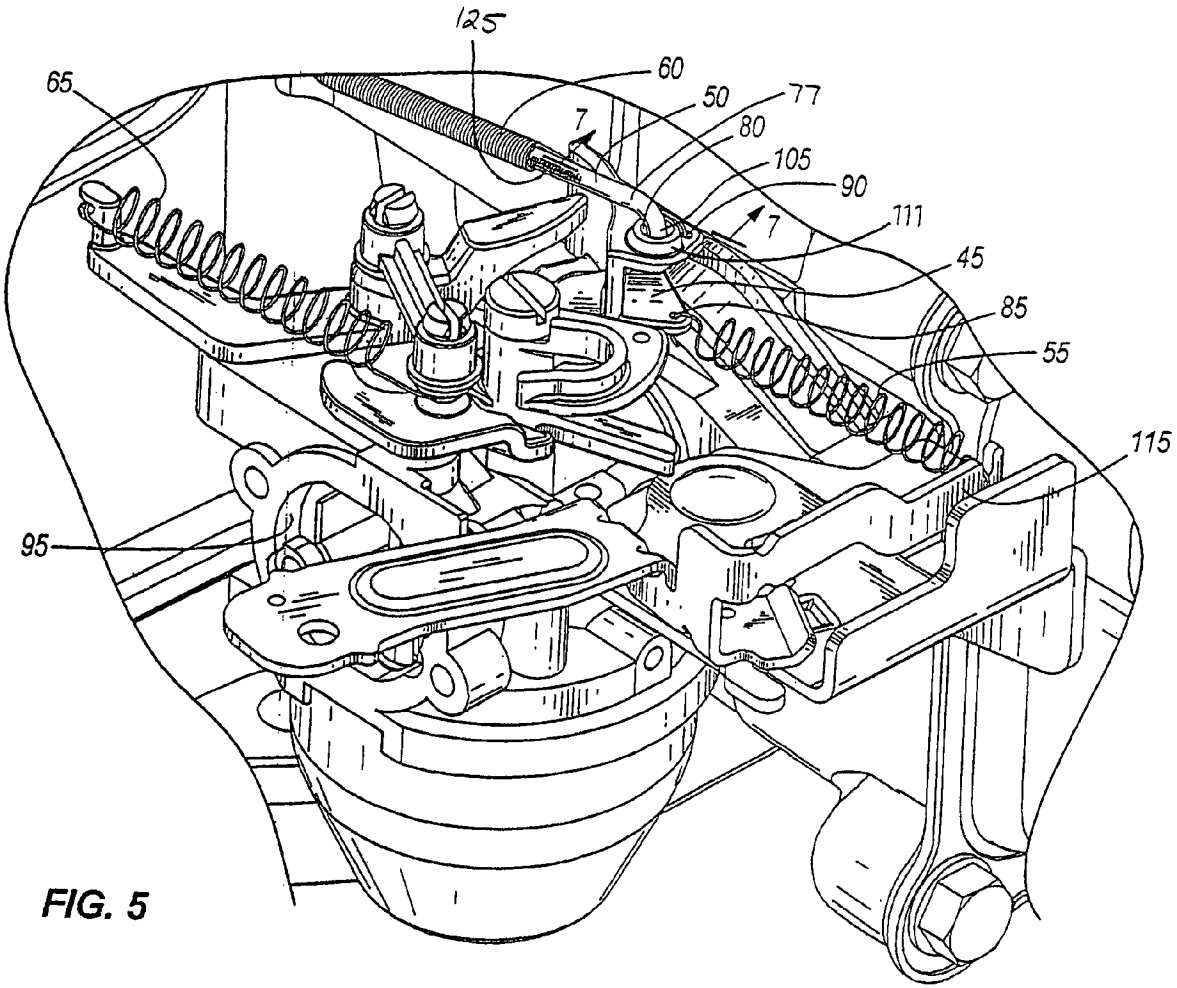
FIG. 5 is an enlarged perspective view of a portion of the governor of FIG. 2.

As shown in FIG. 5, the throttle lever 45 includes a first aperture 80, a second aperture 85, and a third aperture 90. The second aperture 85 is spaced a distance apart from the first aperture 80 and the third aperture 90 is spaced a distance apart from the first and second apertures 80, 85.

Figure 4:
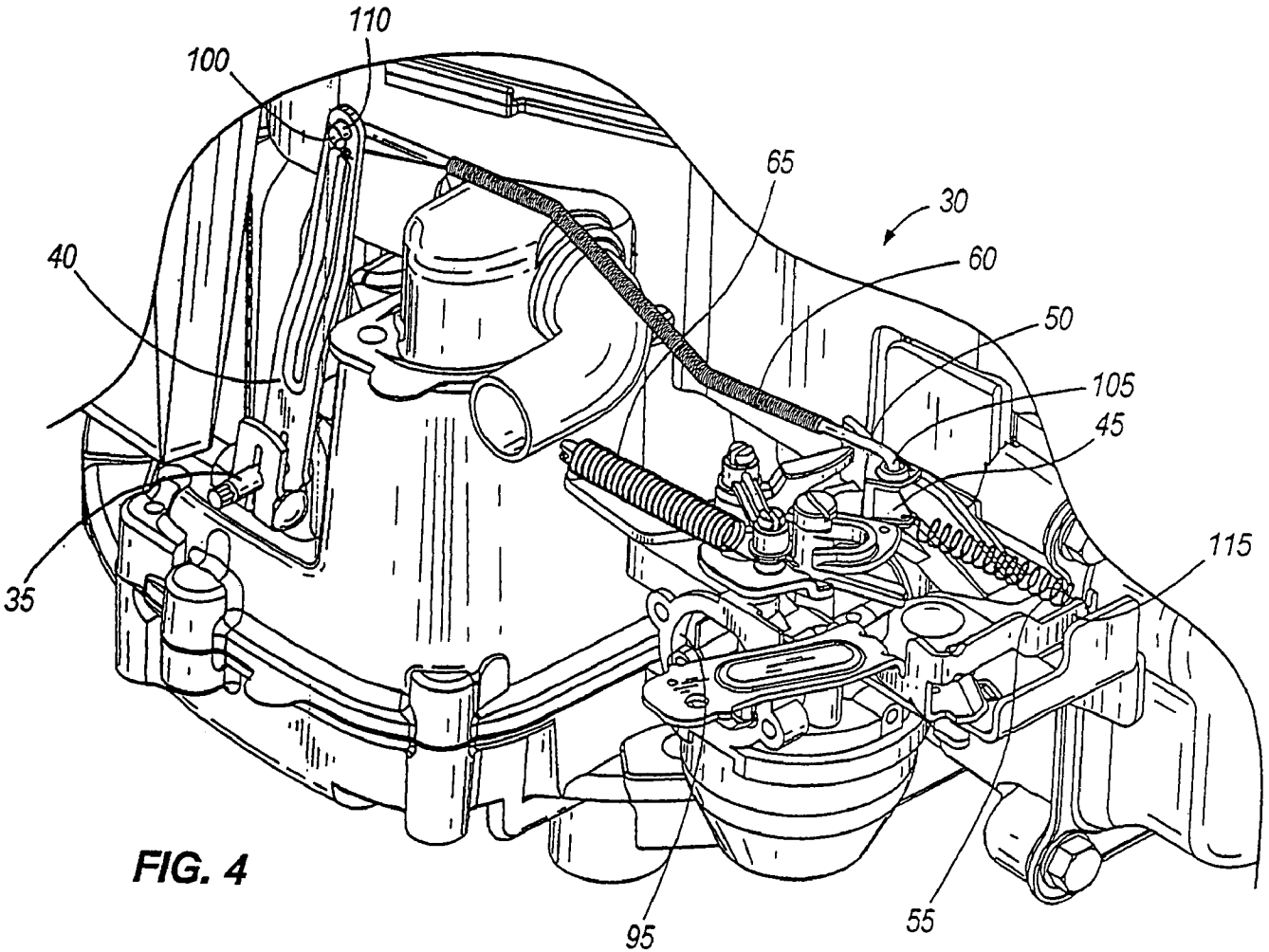
FIG. 4 is a perspective view of the governor of FIG. 2.
Figure 6:
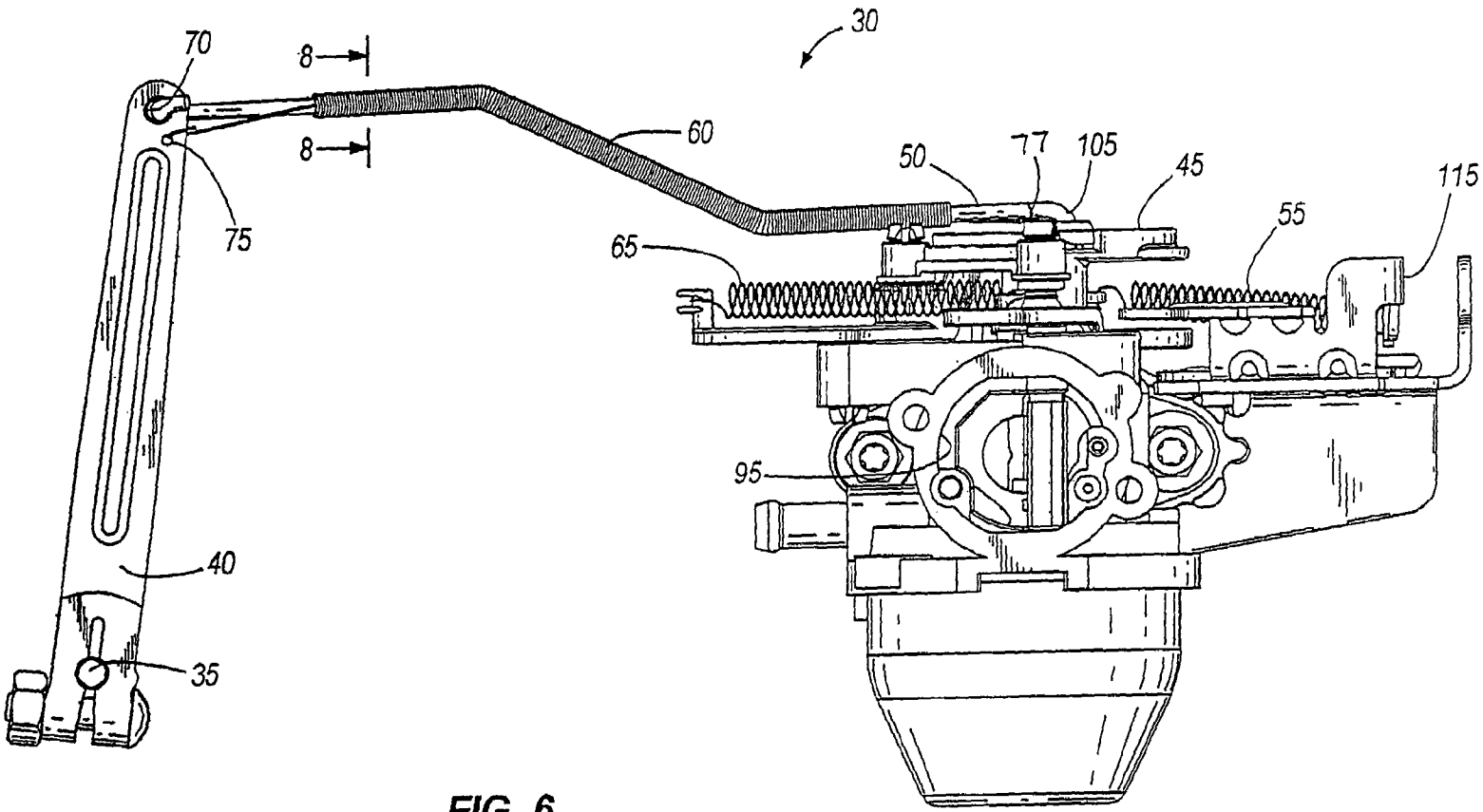
FIG. 6 is a side view of a portion of the governor of FIG. 2.

As shown in FIGS. 2, 4, and 6, a first portion of the governor arm 40 is coupled to the governor shaft 35. As shown in FIGS. 4 and 6, a second portion of the governor arm 40 includes a first hole 70 to receive an end of the linkage 50 and a second hole 75 to receive an end of the friction spring 60. The first hole 70 is spaced a distance apart from the second hole 75.

FIGS. 3-6 show the governor 30 that further includes a linkage 50, a governor spring 55, and a friction spring 60. The linkage 50 includes a circumferential arc 77 having a diameter 78 (FIG. 8), and a first end of the linkage 50 is attached to the governor arm 40 within the first hole 70 and includes a first bend 100. A spacer 110 made of resilient material may be disposed within the first hole 70 to receive the first end of the linkage 50. A second end of the linkage 50 attaches to the throttle lever 45 within the first aperture 80 and includes a second bend 105. A second spacer 111 is disposed in the first aperture 80 to receive the second end of the linkage 50.

The governor spring 55 includes a coil portion that defines a first spring rate. The governor spring applies a force vector to bias the throttle lever 45 in a first direction. As shown in FIG. 5, the governor spring 55 is attached to the second aperture 85 adjacent to and spaced from the attachment of the linkage 50 to the throttle lever 45. As shown in FIGS. 4 and 5, the governor spring 55 is attached to a fixed member 115 of the engine 15 opposite the throttle lever 45.

Figure 8:
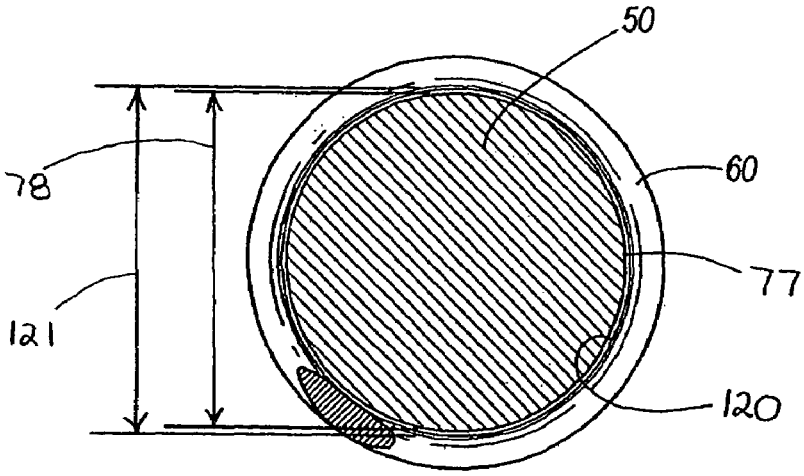
FIG. 8 is a section view of the linkage and a friction spring of the governor of FIG. 6, taken along line 8-8.

FIGS. 5 and 6 show the friction spring 60 coupled to the second hole 75 that is disposed in the governor arm 40, and to the third aperture 90 that is disposed in the throttle member 45. The friction spring 60 includes a coil portion that defines a second spring rate and an inner circumferential arc 120 having a diameter 121 (FIG. 8).

The friction spring 60 is chosen such that the second spring rate is less than the first spring rate. In one embodiment, the second spring rate is between about 20 percent and 75 percent of the first spring rate. Other embodiments of the friction spring 60 may include a second spring rate that is lower than 20 percent, or higher than 75 percent of the first spring rate.

The linkage 50 is at least partially disposed within the coil portion of the friction spring 60. As shown in FIG. 8, the coil portion tightly winds around the linkage 50 such that the diameter 121 of the circumferential arc 120 is substantially equal to the diameter 78 of the circumferential arc 77. As such, the outer surface of the linkage 50 is substantially engaged by the inner surface of the friction spring 60. In other embodiments, the diameter 121 of the circumferential arc 120 can be slightly different than the diameter 78 of the circumferential arc 77 such that the outer surface of the linkage 50 is at least partially engaged by the inner surface of the friction spring 60.

The engagement of the outer surface of the linkage 50 and the inner surface of the friction spring 60 cooperate to define a coefficient of friction to dampen movement of the linkage 50 in response to movement of the governor arm 40. The friction spring 60 applies a force vector that is normal to the movement of the linkage 50 such that the normal force vector generates friction between the linkage 50 and the friction spring 60 to oppose motion of the linkage 50. The force vector of the friction spring 60 is applied in a second direction that is opposite the first direction of the force vector of the governor spring 55. The close engagement of the circumferential surface 120 of the friction spring 60 and the circumferential surface 77 of the linkage 50 at least partially determines a portion of the coefficient of friction between the linkage 50 and the friction spring 60.

The linkage 50 and the friction spring 60 cooperate to define a coefficient of friction to dampen movement of the linkage 50 in response to movement of the governor arm 40. The friction spring 60 applies a force vector that is normal to the movement of the linkage 50 such that this normal force vector generates friction between the linkage 50 and the friction spring 60 to oppose motion of the linkage 50. The close engagement of the circumferential arc 77 and the inner surface of the friction spring 60 on the one hand, and the circumferential arc 120 and the outer surface of the linkage 50 on the other hand at least partially determine a portion of the coefficient of friction between the linkage 50 and the friction spring 60.

In some embodiments, the linkage 50 includes a friction enhancing surface 125 (e.g., a roughened surface, a scored surface, etc.) to increase friction between the linkage 50 and the friction spring 60. The friction enhancing surface 125 (FIG. 5) defines a coefficient of friction between the linkage 50 and the friction spring 60 that is greater than the coefficient of friction between other portions of the linkage 50 and the friction spring 60. In other embodiments, a friction enhancing surface may be disposed on the friction spring 60. In still other embodiments, the friction enhancing surface may be disposed on both the linkage 50 and the friction spring 60. The friction enhancing surface 125 provides additional dampening of the movement of the throttle lever 45 between the first and second positions. As the linkage 50 moves in response to the governor arm 40 and pivots the throttle lever 45, the corresponding coefficient of friction induces resistance to the movement of the linkage 50.

In some embodiments, the linkage 50 includes a friction enhancing surface (e.g., a roughened surface, a scored surface, etc.) to increase friction between the linkage 50 and the friction spring 60. The friction enhancing surface (not shown) defines a coefficient of friction between the linkage 50 and the friction spring 60 that is greater than the coefficient of friction between other portions of the linkage 50 and the friction spring 60. In other embodiments, the friction enhancing surface may be disposed on the friction spring 60. In still other embodiments, the friction enhancing surface may be disposed on both the linkage 50 and the friction spring 60. The friction enhancing surface provides additional dampening of the movement of the throttle lever 45 between the first and second positions. As the linkage 50 moves in response to the governor arm 40 and pivots the throttle lever 45, the corresponding coefficient of friction induces resistance to the movement of the linkage 50.

During operation, the engine 15 operates at a desired speed that is based on the applied load. The speed sensor 25 senses the rotational speed of the crankshaft 19 and generates a signal indicative of a speed of the engine 15. The speed sensor 25 responds to the engine speed and engages the governor shaft 35. The governor arm 40 rotates with the governor shaft 35 in response to the signal from the speed sensor 25 to vary the flow of fuel and air to the combustion chamber 18. The linkage 50 moves in response to rotation of the governor arm 40, which in turn moves the throttle lever 45 between the first and second positions.

The force vector of the governor spring 55 biases the throttle lever 45 in the first direction toward the fixed member 115. The friction spring 60 engages the throttle lever 45 to resist movement of the linkage 50. More specifically, the inner surface of the friction spring 60 engages a portion of the outer surface of the linkage 50 to limit movement of the linkage 50. The force vector applied by the friction spring 60 biases the throttle lever 45 in the second direction that is substantially opposite the bias of the force vector applied by the governor spring 55.

Figure 7:
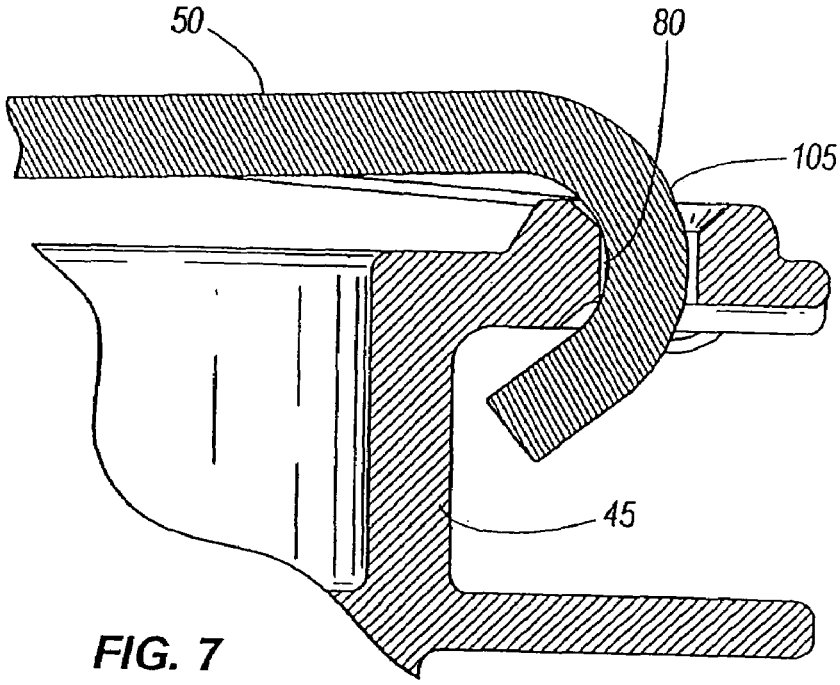
FIG. 7 is a section view of a linkage of the governor of FIG. 5 coupled to a throttle lever of the engine, taken along line 7-7.

FIG. 7 shows the connection of the linkage 50 to the throttle lever 45 within the first aperture 80. The engagement of the governor spring 55 with the throttle lever 45 biases the throttle lever 45 in the first direction such that an inner portion of the second bend 105 is vertically centered within the first aperture 80. Vertically centering the second bend 105 in the first aperture 80 consistently positions an inner portion of the second bend 105 against a side of the first aperture 80. The vertical centering of the second bend 105 also limits movement of the second bend 105 within the first aperture 80.

As illustrated in FIGS. 5 and 6, the distance between the attachments of the linkage 50 and the attachments of the friction spring 60 to separate portions of the governor arm 40 and the throttle lever 45 further contributes to the normal force vector or coefficient of friction between the linkage 50 and the friction spring 60. Attachment of the friction spring 60 within the second hole 75 spaced a distance apart from the first hole 70 determines a portion of the normal force vector between the linkage 50 and the friction spring 60. Similarly, attachment of the friction spring 60 within the third aperture 90 spaced a distance apart from the first aperture 80 that receives the linkage 50 determines a portion of the normal force vector between the linkage 50 and the friction spring 60. For example, increasing the distance between the first hole 70 and the second hole 75, and between the first aperture 80 and the third aperture 90, increases the normal force vector and therefore the frictional force or coefficient of friction between the linkage 50 and the friction spring 60. Decreasing the distance between the first and second holes 70, 75 and the first and third apertures 80, 90 decreases the frictional force or coefficient of friction between the linkage 50 and the friction spring 60.

The friction enhancing surface on at least one of the linkage 50 and the friction spring 60 may provide additional control of the movement of throttle lever 45. As the linkage 50 moves in response to the governor arm 40 and pivots the throttle lever 45, the coefficient of friction induces resistance to the movement of the throttle member 45.

Various features and advantages of the invention are set forth in the following claims.

What is claimed is:

1. A governor for an engine, the governor comprising:
- a speed sensor coupled to the engine and movable in response to changes in a speed of the engine;
- a throttle member movable between a first position and a second position;
- a linkage coupled to the speed sensor and the throttle member to move the throttle member between the first position and the second position;
- a governor spring coupled to the throttle member; and
- a friction spring including a first end that passes through an aperture in the throttle member and a coil portion frictionally engaged with at least a portion of the linkage.

2. The governor of claim 1, wherein the linkage and the friction spring cooperate to define a coefficient of friction therebetween.

3. The governor of claim 1, wherein the throttle member includes an aperture to receive a portion of the linkage, and wherein the governor spring and the friction spring cooperate to vertically center a portion of the linkage in the aperture.

4. The governor of claim 1, wherein a portion of the linkage is disposed within the coil portion.

5. The governor of claim 1, wherein the speed sensor includes flyweights to sense a speed of the engine and a governor arm that engages the linkage and that is movable in response to movement of the flyweights.

6. A governor for an engine, the governor comprising:
- a speed sensor coupled to the engine and movable in response to changes in a speed of the engine;
- a throttle member movable between a first position and a second position;
- a linkage coupled to the speed sensor and the throttle member to move the throttle member between the first position and the second position;
- a governor spring coupled to the throttle member; and
- a friction spring coupled to the throttle member and including a coil portion frictionally engaged with at least a portion of the linkage, wherein the coil portion includes an inner circumferential arc having a first diameter and the linkage includes a circumferential arc having a second diameter that is substantially equal to the first diameter.

7. A governor for an engine, the governor comprising:
- a speed sensor coupled to the engine and movable in response to changes in a speed of the engine;
- a throttle member movable between a first position and a second position;

a linkage coupled to the speed sensor and the throttle member to move the throttle member between the first position and the second position;

a governor spring coupled to the throttle member; and a friction spring coupled to the throttle member and including a coil portion frictionally engaged with at least a portion of the linkage, wherein the governor spring includes a first spring rate and the friction spring includes a second spring rate, and wherein the second spring rate is between about 20 percent and 75 percent of the first spring rate.

8. A governor for an engine, the governor comprising:

a speed sensor coupled to the engine and movable in response to changes in a speed of the engine;

a throttle member movable between a first position and a second position;

a linkage coupled to the speed sensor and the throttle member to move the throttle member between the first position and the second position;

a governor spring coupled to the throttle member; and a friction spring coupled to the throttle member and including a coil portion frictionally engaged with at least a portion of the linkage, wherein the speed sensor includes flyweights to sense a speed of the engine and a governor arm that engages the linkage and that is movable in response to movement of the flyweights, and wherein the governor spring is coupled to the throttle member and the engine to apply a force to bias the throttle member in a first direction, and wherein the friction spring is coupled to the governor arm and the throttle member to apply a force that is substantially in opposition to a force of the governor spring.

9. A governor for an engine, the governor comprising:

a speed sensor coupled to the engine and movable in response to changes in a speed of the engine;

a throttle member movable between a first position and a second position;

a linkage coupled to the speed sensor and the throttle member to move the throttle member between the first position and the second position;

a governor spring coupled to the throttle member; and a friction spring coupled to the throttle member and including a coil portion frictionally engaged with at least a portion of the linkage, wherein attachment of the friction spring to a governor arm is spaced a distance from attachment of the linkage to the governor arm, and wherein the distance between the attachment of the friction spring and the linkage partially defines a coefficient of friction between the linkage and the friction spring.

10. A governor for an engine, the governor comprising:

a speed sensor coupled to the engine and movable in response to changes in a speed of the engine;

a throttle member movable between a first position and a second position;

a linkage coupled to the speed sensor and the throttle member to move the throttle member between the first position and the second position;

a governor spring coupled to the throttle member; and a friction spring coupled to the throttle member and including a coil portion frictionally engaged with at least a portion of the linkage, wherein attachment of the friction spring to the throttle member is spaced a distance from attachment of the linkage to the throttle member, and wherein the distance between the attachment of the friction spring and the linkage partially defines a coefficient of friction between the linkage and the friction spring.

11. An internal combustion engine comprising:

a cylinder;

a combustion chamber;

a piston disposed within the cylinder and reciprocal in response to combustion of a fuel in the combustion chamber;

a speed sensor coupled to the engine and movable in response to changes in a speed of the engine;

a throttle member movable between a first position and a second position;

a linkage coupled between the speed sensor and the throttle member, the linkage movable in a first direction and a second direction to vary the throttle member between the first position and the second position;

a governor spring coupled to the throttle member to bias the throttle member in a first direction; and a friction spring coupled to the throttle member and including a first end that passes through an aperture in the governor arm such that the friction spring resists movement of the linkage in both the first direction and the second direction.

12. The engine of claim 11, wherein the governor spring defines a first spring rate and the friction spring defines a second spring rate, and wherein the second spring rate is between about 20 percent and 75 percent of the first spring rate.

13. The engine of claim 11, wherein the friction spring includes a coil portion to receive at least a portion of the linkage.

14. The engine of claim 11, wherein the linkage and the friction spring cooperate to define a coefficient of friction therebetween.

15. The engine of claim 11, wherein the speed sensor includes flyweights to sense a speed of the engine and a governor arm that engages the linkage and that is movable in response to movement of the flyweights.

16. The engine of claim 15, wherein the friction spring is coupled to the governor arm and the throttle member to frictionally engage the linkage.

17. An internal combustion engine comprising:

a cylinder;

a combustion chamber;

a piston disposed within the cylinder and reciprocal in response to combustion of a fuel in the combustion chamber;

a speed sensor coupled to the engine and movable in response to changes in a speed of the engine;

a throttle member movable between a first position and a second position;

a linkage coupled between the speed sensor and the throttle member, the linkage movable in a first direction and a second direction to vary the throttle member between the first position and the second position;

a governor spring coupled to the throttle member to bias the throttle member in a first direction; and a friction spring coupled to the governor arm and the throttle member to resist movement of the linkage in both the first direction and the second direction, wherein the throttle member includes an aperture to receive a portion of the linkage, and wherein the governor spring and the friction spring cooperate to vertically center a portion of the linkage in the aperture.

18. An internal combustion engine comprising:

a cylinder;

a combustion chamber;

a piston disposed within the cylinder and reciprocal in response to combustion of a fuel in the combustion chamber;

a speed sensor coupled to the engine and movable in response to changes in a speed of the engine;

a throttle member movable between a first position and a second position;

a linkage coupled between the speed sensor and the throttle member, the linkage movable in a first direction and a second direction to vary the throttle member between the first position and the second position;

a governor spring coupled to the throttle member to bias the throttle member in a first direction; and a friction spring coupled to the governor arm and the throttle member to resist movement of the linkage in both the first direction and the second direction, wherein the friction spring includes a coil portion to receive at least a portion of the linkage, and wherein the coil portion includes an inner circumferential arc having a first diameter, and wherein the linkage includes a circumferential arc having a second diameter that is substantially equal to the first diameter.

19. An internal combustion engine comprising:

a cylinder;

a combustion chamber;

a piston disposed within the cylinder and reciprocal in response to combustion of a fuel in the combustion chamber;

a speed sensor coupled to the engine and movable in response to changes in a speed of the engine;

a throttle member movable between a first position and a second position;

a linkage coupled between the speed sensor and the throttle member, the linkage movable in a first direction and a second direction to vary the throttle member between the first position and the second position;

a governor spring coupled to the throttle member to bias the throttle member in a first direction; and a friction spring coupled to the governor arm and the throttle member to resist movement of the linkage in both the first direction and the second direction, wherein an attachment point of the friction spring to a governor arm is spaced a distance from an attachment point of the linkage to the governor arm, and wherein the distance between the attachment point of the friction spring and the attachment point of the linkage partially defines a coefficient of friction between the linkage and the friction spring.

20. An internal combustion engine comprising:

a cylinder;

a combustion chamber;

a piston disposed within the cylinder and reciprocal in response to combustion of a fuel in the combustion chamber;

a speed sensor coupled to the engine and movable in response to changes in a speed of the engine;

a throttle member movable between a first position and a second position;

a linkage coupled between the speed sensor and the throttle member, the linkage movable in a first direction and a second direction to vary the throttle member between the first position and the second position;

a governor spring coupled to the throttle member to bias the throttle member in a first direction; and a friction spring coupled to the governor arm and the throttle member to resist movement of the linkage in both the first direction and the second direction, wherein an attachment point of the friction spring to the throttle member is spaced a distance from an attachment point of the linkage to the throttle member, and wherein the distance between the attachment point of the friction spring and the attachment point of the linkage partially defines a coefficient of friction between the linkage and the friction spring.

* * * * *